US009694624B2

(12) United States Patent
Chen

(10) Patent No.: US 9,694,624 B2
(45) Date of Patent: Jul. 4, 2017

(54) AUTOMATIC COVER-OPENING DEVICE

(71) Applicant: SDI CORPORATION, Chang Hua (TW)

(72) Inventor: Szu-Yu Chen, Chang Hua (TW)

(73) Assignee: SDI Corporation, Chang Hua (TW)

( * ) Notice: Subject to any disclaimer, the term of this patent is extended or adjusted under 35 U.S.C. 154(b) by 0 days.

(21) Appl. No.: 14/603,648

(22) Filed: Jan. 23, 2015

(65) Prior Publication Data

US 2015/0322704 A1 Nov. 12, 2015

(30) Foreign Application Priority Data

May 9, 2014 (TW) ..... 103116642 A

(51) Int. Cl.
*B43L 23/08* (2006.01)

(52) U.S. Cl.
CPC ..... *B43L 23/08* (2013.01)

(58) Field of Classification Search
CPC ..... B43L 23/00
See application file for complete search history.

(56) References Cited

U.S. PATENT DOCUMENTS 865,572 A * 9/1907 Dawson ..... B01D 23/28 141/297
2,233,681 A * 3/1941 Swanson ..... B43L 23/00 144/28.5
2,520,020 A * 8/1950 Sollosy ..... B43L 23/00 144/28.5
4,601,316 A * 7/1986 Verdi ..... B43L 23/008 144/28.5
6,083,392 A * 7/2000 Rigney ..... A47J 37/1271 210/451
6,334,256 B1 * 1/2002 Luttgens ..... B43L 23/08 30/453

(Continued)

FOREIGN PATENT DOCUMENTS

CN 202573548 U 12/2012
DE 2513051 A1 10/1976

(Continued)

OTHER PUBLICATIONS

Communication From the European Patent Office Regarding a Counterpart Foreign Office Action Dated Sep. 23, 2015.

*Primary Examiner* — Katherine Mitchell
*Assistant Examiner* — Catherine A Kelly
(74) *Attorney, Agent, or Firm* — Rosenberg, Klein & Lee

(57) ABSTRACT

An automatic cover-opening device has a body, at least one cover panel and a recoil mechanism. The body has an insertion hole defined in the body. The at least one cover panel is mounted on the body and moveably closes the insertion hole. Each one of the at least one cover panel has a guiding segment having at least one guiding edge inclined relative to an axis of the insertion hole to guide an axial force along the axis of the insertion hole to a lateral direction non-parallel with the axis, so as to generate a lateral component force for opening the at least one cover panel. The recoil mechanism is disposed on the body to push the at least one cover panel to a closed position for closing the insertion hole. With such an arrangement, an automatic cover-opening device that can be applied for insertion of a rod-like object is provided.

17 Claims, 13 Drawing Sheets

(56) References Cited

U.S. PATENT DOCUMENTS

| | | | | |
|---|---|---|---|---|
| 6,334,475 | B1 * | 1/2002 | Schultheiss | B43L 23/04 144/28.1 |
| 6,574,875 | B2 * | 6/2003 | Lawson | B43L 23/00 30/461 |
| 6,948,251 | B2 * | 9/2005 | Jebe | B43L 23/00 30/452 |
| 7,360,566 | B2 * | 4/2008 | Chang | B43L 23/00 144/28.5 |
| 7,455,087 | B2 * | 11/2008 | Mak | B43L 23/00 144/28.4 |
| 2011/0186178 | A1 * | 8/2011 | Chang | B43L 23/00 144/28.5 |
| 2011/0288483 | A1 * | 11/2011 | Zhou | A61B 17/3462 604/167.03 |
| 2011/0290376 | A1 * | 12/2011 | Farooq | B43L 23/00 144/28.4 |
| 2013/0147104 | A1 * | 6/2013 | Saito | B43L 23/04 269/218 |
| 2014/0209211 | A1 * | 7/2014 | Wu | B43L 23/00 144/28.6 |

FOREIGN PATENT DOCUMENTS

| | | | |
|---|---|---|---|
| DE | 10301751 | A1 | 7/2004 |
| EP | 0031470 | A1 | 7/1981 |

* cited by examiner

AUTOMATIC COVER-OPENING DEVICE

BACKGROUND OF THE INVENTION

1. Field of the Invention

The present invention relates to an automatic cover-opening device, and more particularly to an automatic cover-opening device that can be applied for insertion of an object.

2. Description of Related Art

A vessel, such as a pencil sharpener, usually has a cover to close an opening of the vessel and to prevent particles or scraps in the vessel from discharging from the opening of the vessel. China Patent No. 202573548, entitled "environmentally friendly pencil sharpener" (hereinafter referred to as '548 patent), substantially comprises two sliding panels pivotal relative to each other. Each sliding panel has a conical recess corresponding in position to a pencil hole of the sharpener. Accordingly, when a pencil is inserted into the sharpener, the pencil can push the sliding panels to pivotally rotate along the conical recesses to open the pencil hole. Consequently, the pencil can be sharpened by the blade in the sharpener.

However, the conventional cover-opening device of the '548 patent can only be applied to a sharpened pencil having a conical tip. When a brand new, unsharpened pencil having a flat end is inserted into the sharpener, the conical recesses in the sliding panels cannot transfer the axial insertion force of the flat end of the pencil to lateral force, which is for pushing the sliding panels to move. Therefore, the sliding panels are not pivoted relative to each other, and the pencil hole in the sharpener cannot be opened. Moreover, the sliding panels will be closed to each other due to the normal force of the pencil. Therefore, the conventional cover-opening device is limited and inconvenient in use.

To overcome the shortcomings, the present invention tends to provide an automatic cover-opening device to mitigate or obviate the aforementioned problems.

SUMMARY OF THE INVENTION

The main objective of the invention is to provide an automatic cover-opening device that can be applied for insertion of an object that has a flat end. An object having either a conical end or a flat end can easily open the cover and the cover can be automatically closed, such that the automatic cover-opening device is versatile and convenient in use.

The automatic cover-opening device has a body, at least one cover panel and a recoil mechanism. The body has an insertion hole defined in the body. The at least one cover panel is mounted on the body and is displaceable to open and close the insertion hole. The at least one cover panel has a recess defining a tapered or flat bottom surface. A guiding segment is formed on said bottom surface. Said guiding segment is inclined relative to an axis of the insertion hole and has at least one inclined abutting rib defining an inclined wall extending above said bottom surface. Said inclined wall has an inclined guiding edge, whereby a lateral component force is generated due to the inclined guiding edge for displacing said at least one cover panel for opening the insertion hole.

With such an arrangement, the guiding segment on the at least one cover panel can effectively guide an axial insertion force of a pencil or a rod-like object to a lateral direction, so as to form a lateral component force for automatically opening the at least one cover panel. With the guiding segment, the automatic cover-opening device can be applied for insertion of an object having a flat end, such as a brand new, unsharpened pencil. Accordingly, the automatic cover-opening device can be applied for an object having either a conical end or a flat end, and the cover panel can be easily opened and automatically closed, so as to improve the versatility and convenience of the automatic cover-opening device.

Other objects, advantages and novel features of the invention will become more apparent from the following detailed description when taken in conjunction with the accompanying drawings.

DETAILED DESCRIPTION OF PREFERRED EMBODIMENT

Figure 1:
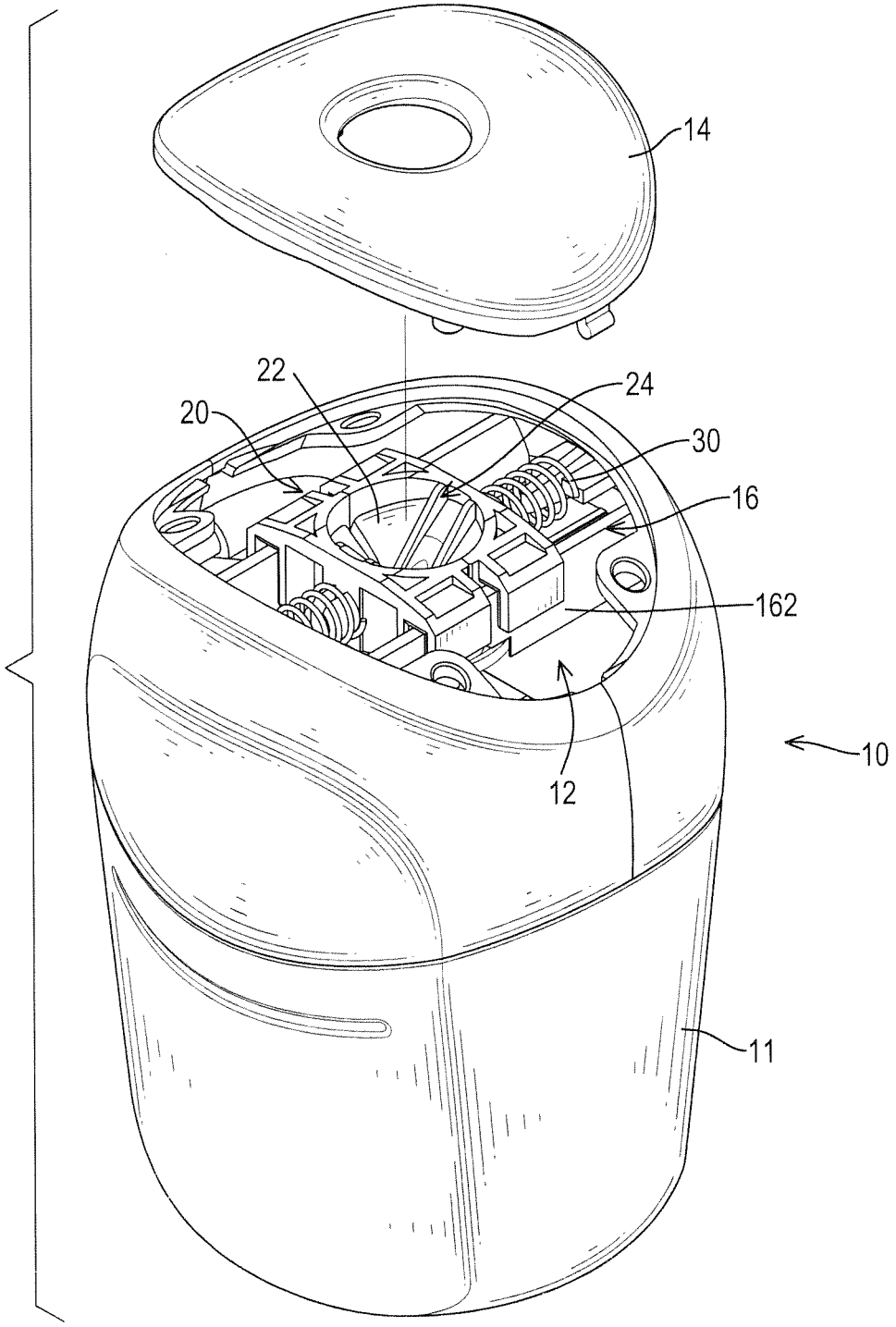
FIG. 1 is a partially exploded perspective view of a first embodiment of an automatic cover-opening device in accordance with the present invention.
Figure 2:
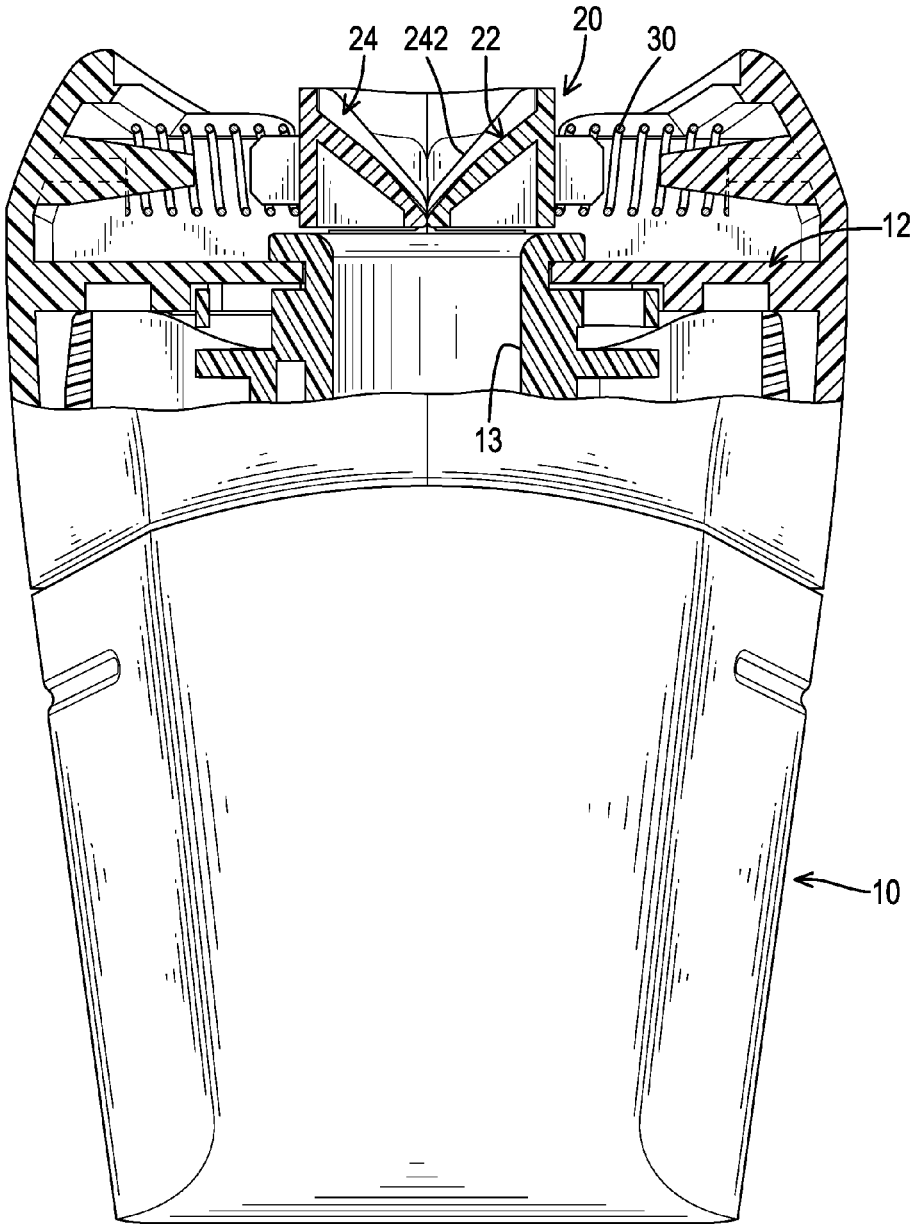
FIG. 2 is a side view in partial section of the automatic cover-opening device in FIG. 1.
Figure 3:
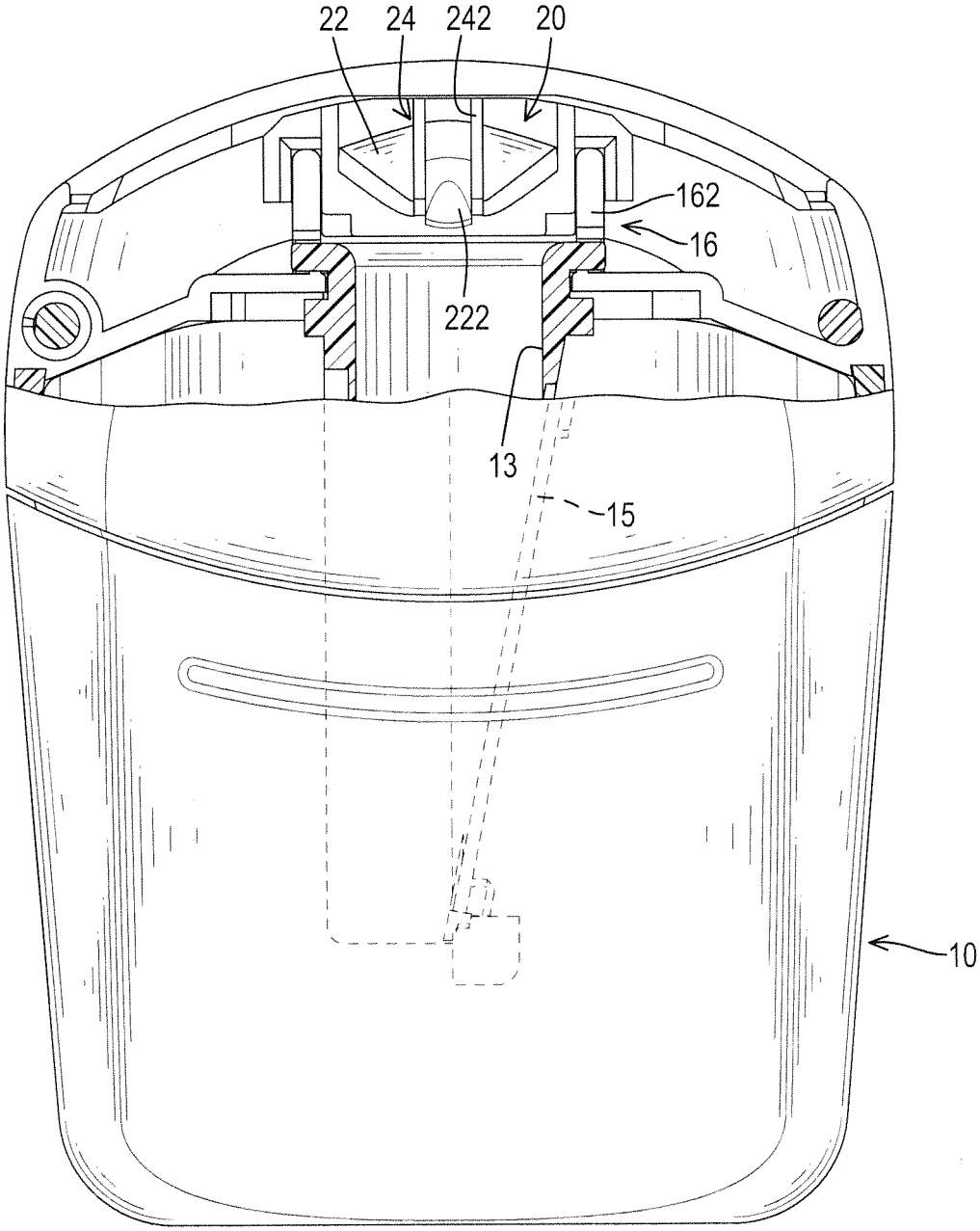
FIG. 3 is another side view in partial section of the automatic cover-opening device in FIG. 1.

An automatic cover-opening device in accordance with the present invention can be applied to any vessel having a cover. A pencil sharpener is an embodiment of the object for description that follows. With reference to FIGS. 1 to 3, the automatic cover-opening device in accordance with the present invention comprises a body 10, at least one cover panel 20 and a recoil mechanism. The body 10 comprises a waste casing 11, a base 12, a top cover 14 and a cutter assembly 15. The base 12 is detachably mounted on the waste casing 11, and the cutter assembly 15 is mounted on the base 12 and is held in the waste casing 11. An insertion hole 13 is defined in the body 10 and has an axis. An axial force is defined as a force along the axis of the insertion hole 13, and a lateral direction is defined as a direction non-parallel with the axis. In the present embodiment, the insertion hole 13 is defined in the cutter assembly 15. The cover panel 20 is moveably mounted on the body 10 and closes the insertion hole 13. Preferably, two cover panels 20 are implemented, and alternatively, one or more than three cover panels may be implemented based on different structural designs. Each cover panel 20 has a tapered recess 22 defined in a top of the cover panel 20. A guiding segment 24 is formed on and protrudes from the tapered recess 22. The guiding segment 24 comprises at least one abutting rib. Each abutting rib has a guiding edge 242 extending along the tapered recess 22 and being inclined relative to the axis of the insertion hole 13. The guiding edges 242 can guide the axial force along the axis of the insertion hole 13 to a lateral direction non-parallel with the axis, so as to generate lateral component force for opening the cover panels 20. With reference to FIG. 1, from a top view, an extending direction of each guiding edge 242 can be parallel with the movement direction of the cover panels 20. Preferably, each cover panel 20 has two abutting ribs. Each abutting rib has a thickness gradually decreasing from a top end to a bottom end of the abutting rib to form a rib with a thick top and a thin bottom. In addition, each tapered recess 22 has a guiding concave 222 defined in the tapered recess 22 at a position adjacent to a bottom of the guiding segment 24. When the guiding segment 24 comprises two abutting ribs, the guiding concave 222 is formed between the bottom ends of the abutting ribs. In the first embodiment, a rail 16 is mounted on a top surface of the base 12 to allow the cover panels 20 to move horizontally on the rail 16 to move close to or away from each other in a straight line. The rail 16 comprises two rail tabs 162 parallel with each other, and the cover panels 20 are moveably mounted over the rail tabs 162. The recoil mechanism is mounted in the body 10 to push the cover panels 20 to a closed position. In the first embodiment, the recoil mechanism may comprise two springs 30 abutting respectively the cover panels 20 or a resilient ring mounted around the cover panels 20.

Figure 4:
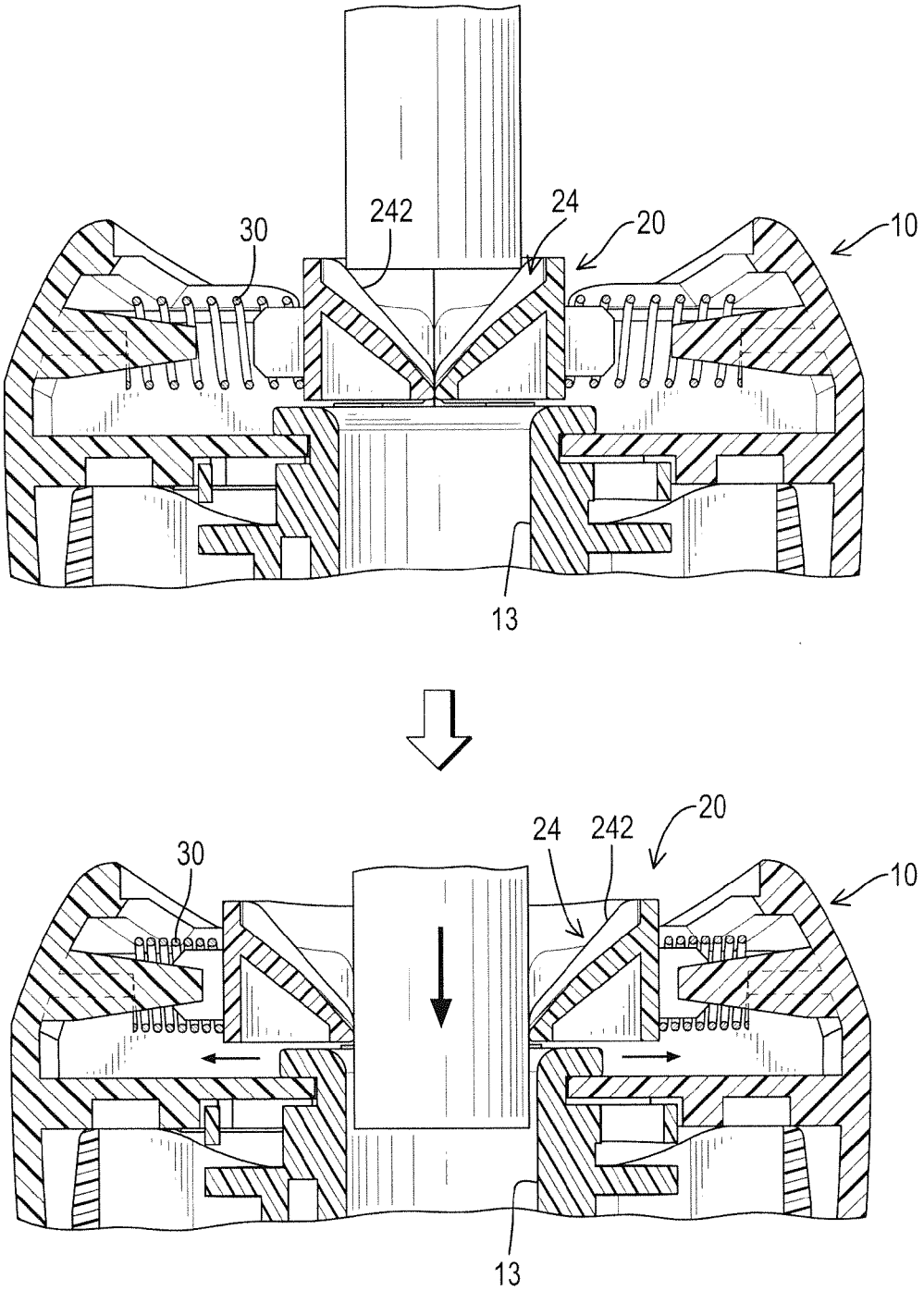
FIG. 4 shows operational side views in partial section of the automatic cover-opening device in FIG. 1 when an object having a flat end is inserted.

With reference to FIGS. 1 and 4, when a pencil is inserted into the pencil sharpener through the top cover 14, the inserted end of the pencil will abut against the guiding segments 24 on the cover panels 20. No matter whether the pencil is sharpened or not and whether with a conical end or a flat end, the radial edge of the pencil will firstly abut the guiding edges 242 without abutting the other parts of the cover panels 20 that are along the direction of ineffective component forces for opening the cover panels 20. Accordingly, when the axial force of insertion of the pencil is exerted on the guiding edges 242, the lateral component force along the lateral direction is generated due to the incline of the guiding edges 242 for opening the cover panels 20. Consequently, the cover panels 20 can be smoothly moved relative to the rail 16, and the insertion hole 13 is open and the pencil can be inserted into the body 10 and sharpened by the cutter assembly 15. Besides, with the abutting ribs each having a thick top and a thin bottom, a sharpened pencil with a conical end can extend deeply and abut lower segments of the guiding edges 242, and a unsharpened pencil with a flat end will abut upper segments of the guiding edges 242, such that the automatic cover-opening device can fit with the two kinds of objects. With the arrangement of the guiding concave 222, the pencil with a conical end can be guided and accurately inserted into the insertion hole 13 so as to improve the utility of the automatic cover-opening device in accordance with the present invention.

After the pencil is sharpened and drawn out from the body 10, the cover panels 20 are pushed to move to the closed position for closing the insertion hole 13 along the rail 16 by the force provided by the springs 30 of the recoil mechanism. Accordingly, scraps collected in the body 10 can be kept from escaping from the insertion hole 13.

A pencil sharpener is one of multiple embodiments of the automatic cover-opening device in accordance with the present invention, and the automatic cover-opening device in accordance with the present invention may be any vessel having a cover. When the automatic cover-opening device is applied to a vessel for containing beverages, a straw having a flat end can be inserted into the vessel and open the cover panels 20 smoothly with the guiding edges 242 on the cover panels 20. In addition, the automatic cover-opening device may be applied to an object, such as an ink bottle to allow a pen to be inserted into the body 10 and open the cover panels 20 smoothly. After the pen is drawn out from the body 10, the cover panels 20 will be closed automatically to keep the ink from being dried.

Figure 5:
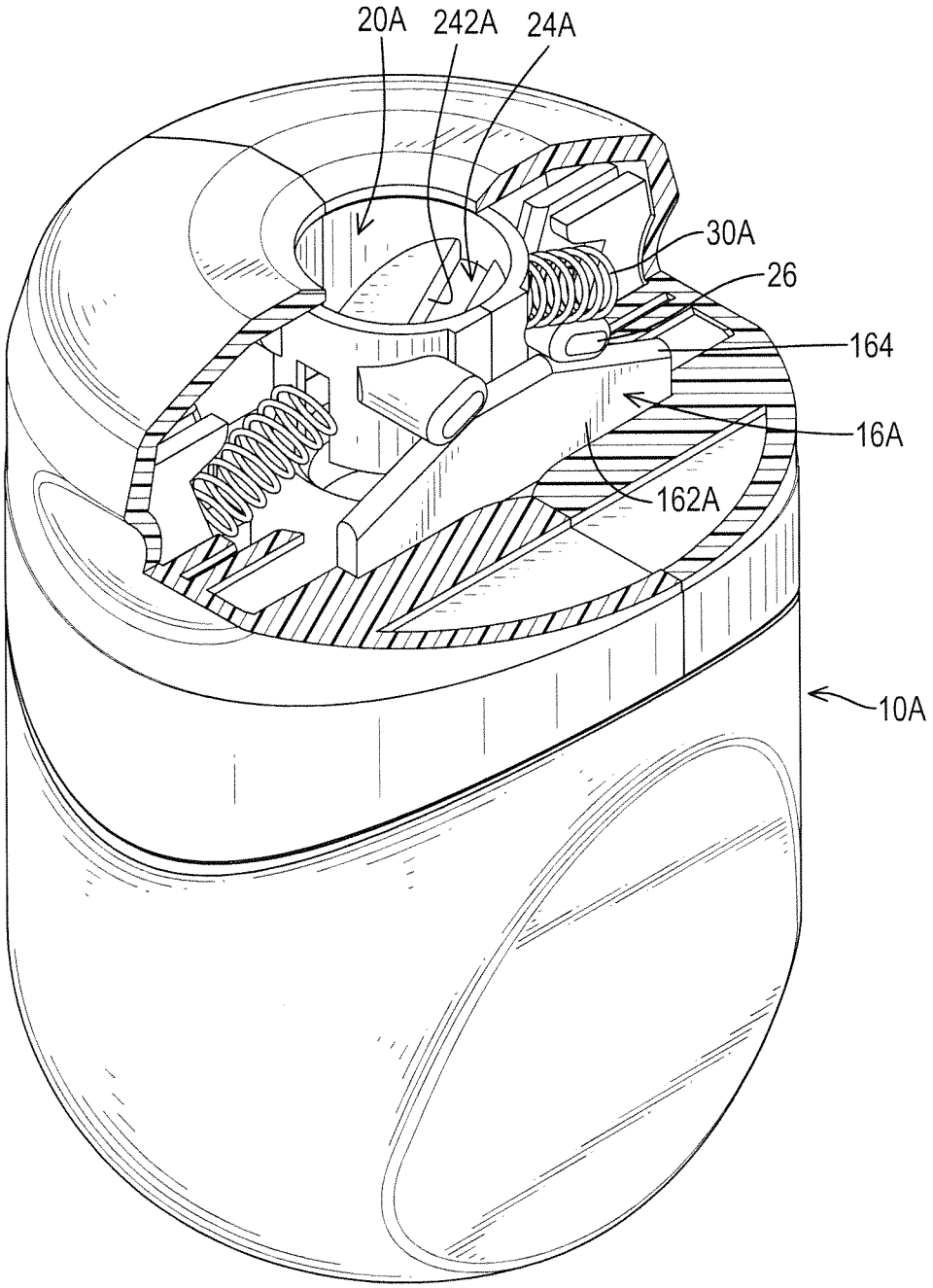
FIG. 5 is a perspective view in partial section of a second embodiment of an automatic cover-opening device in accordance with the present invention.
Figure 6:
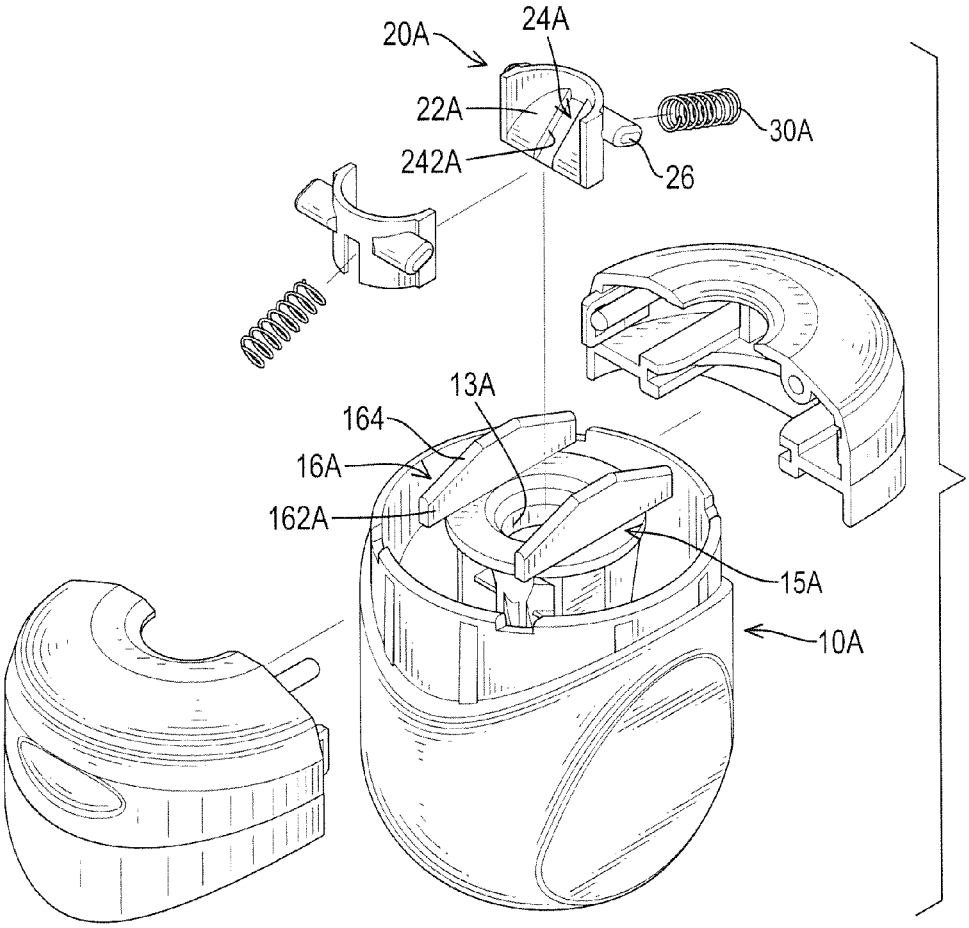
FIG. 6 is an exploded perspective view of the automatic cover-opening device in FIG. 5.
Figure 7:
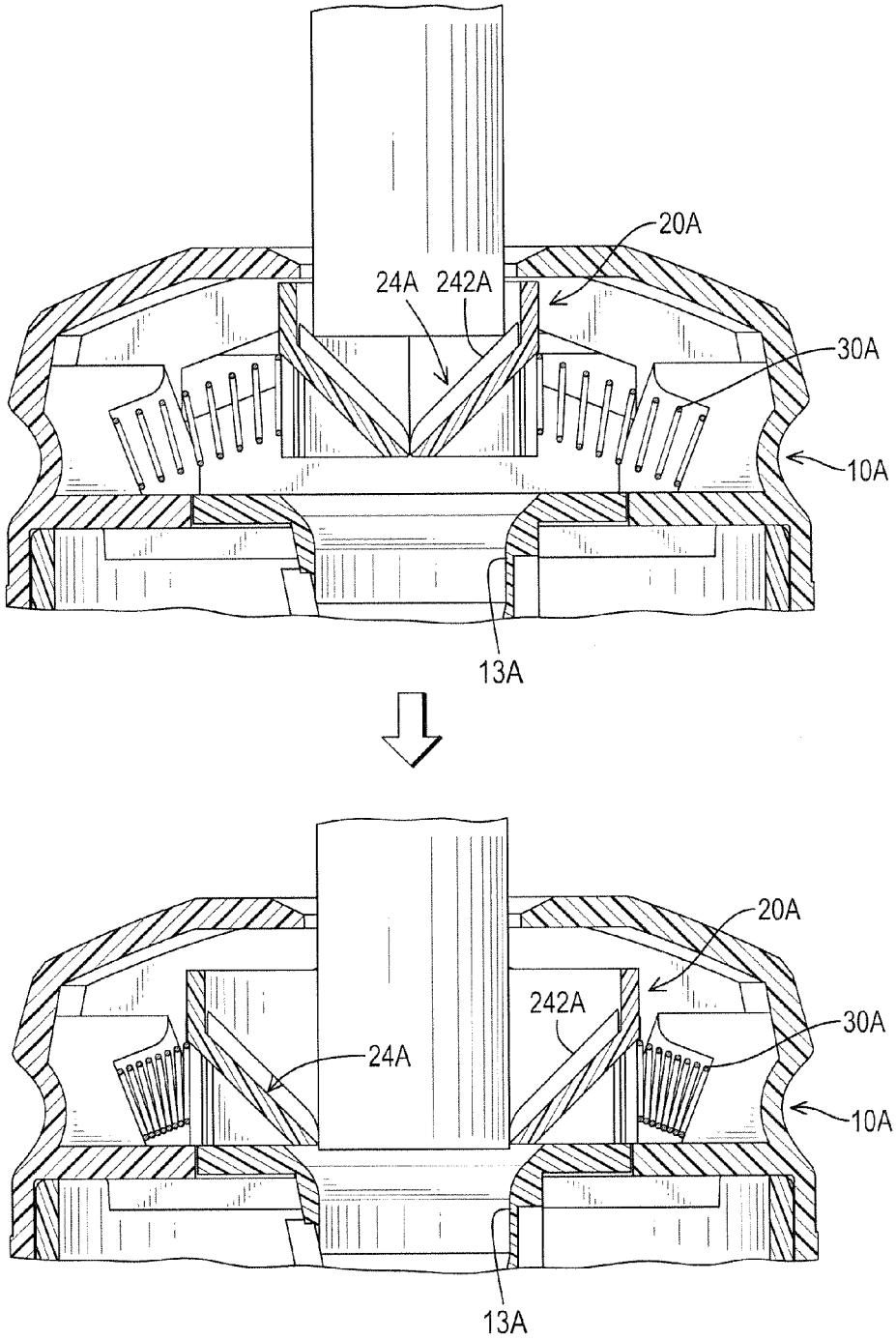
FIG. 7 shows operational side views in partial section of the automatic cover-opening device in FIG. 5 when an object having a flat end is inserted.

With reference to FIGS. 5 and 6, a second embodiment of an automatic cover-opening device in accordance with the present invention, the insertion hole 13A and the rail 16A are disposed on the cutter assembly 15A in the body 10A, and the rail 16A comprises two rail tabs 162A in a substantially trapezoid shape. Each rail tab 162A has two inclined surfaces 164 formed respectively on two sides of the rail tab 162A, and each cover panel 20A has a recess 22A formed in a top surface of the cover panel 20A and having an inclined bottom surface, and each cover panel 20A further has a wing 26 formed on and protruding from a side of the cover panel 20A and moveably abutting the rail tabs 162A. The guiding segment 24A on each cover panel 20A comprises a groove defined in the inclined bottom surface of the recess 22A. Two guiding edges 242A are respectively formed on two sides of the groove. In addition, the springs 30A of the recoil mechanism are both disposed in an inclined manner. With reference to FIG. 7, when a pencil is inserted into the device, the pencil will abut the guiding edges 242A of the groove firstly. With the arrangement of the guiding segment 24A, when the axial force for inserting the pencil is exerted on the guiding edges 242A, the lateral component force along the lateral direction is generated due to an incline of the guiding edges 242A for opening the cover panels 20A will be pushed to move along the inclined surfaces of the rail tabs 162A, and the insertion hole 13A is open. After the pencil is drawn out of the body 10A, the cover panels 20A will be pushed to move to the closed position by the recoil mechanism.

Figure 8:
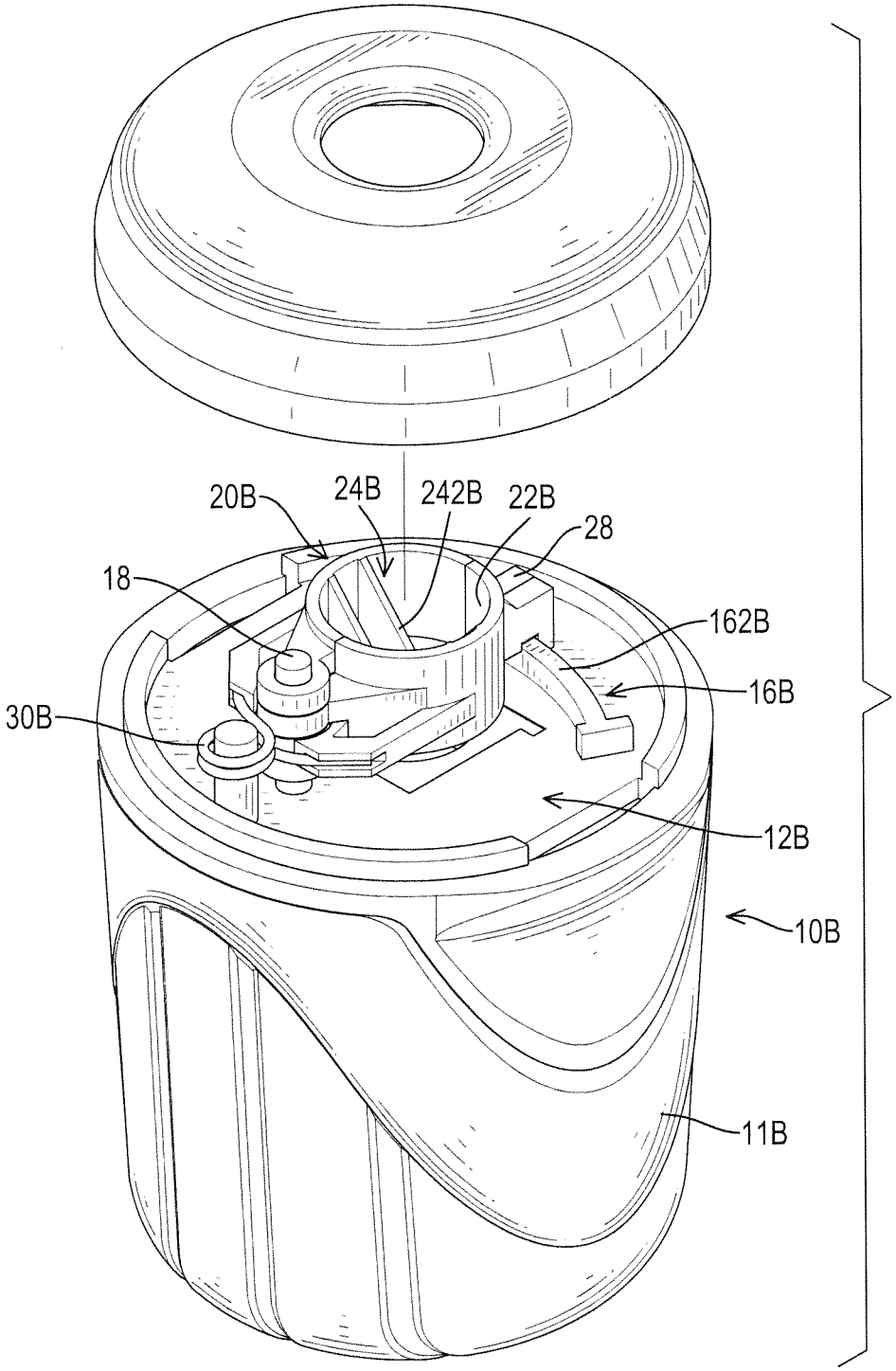
FIG. 8 is a partially exploded perspective view of a third embodiment of an automatic cover-opening device in accordance with the present invention.
Figure 9:
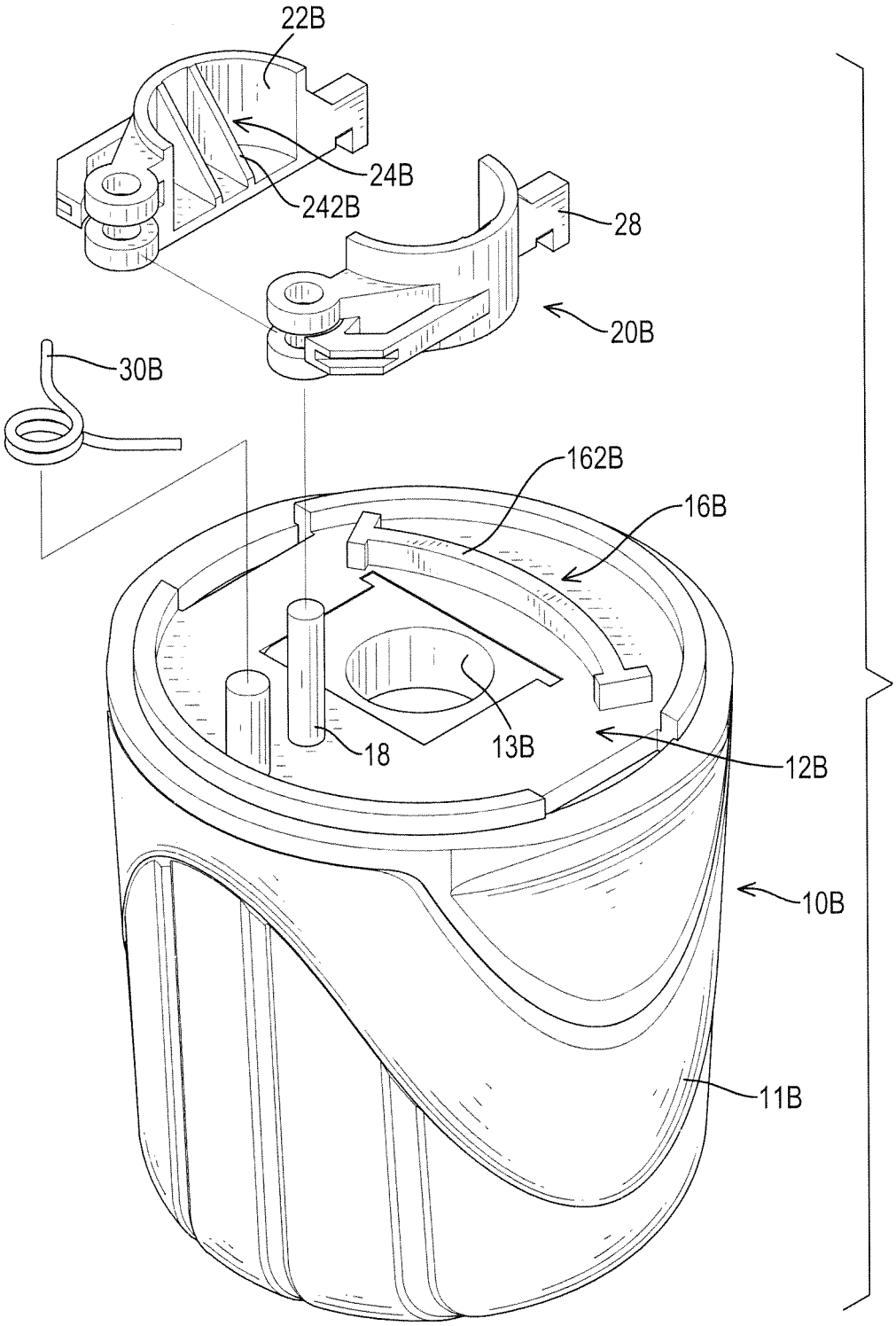
FIG. 9 is an exploded perspective view of the third embodiment of the automatic cover-opening device in FIG. 8.

With reference to FIGS. 8 and 9, a third embodiment of an automatic cover-opening device in accordance with the present invention, the base 12B is mounted on the waste casing 11B, and the insertion hole 13B is defined in the base 12B. Two cover panels 20B are pivotally mounted on a pivotal axle 18 on the body 10B. The rail 16B comprises a curved rail rib 162B formed on a top surface of the base 12B and having a center at the pivotal axle 18. The coil mechanism comprises a torque spring 30B having two ends abutting the two cover panels 20B. Each cover panel 20B has a rail bracket 28 formed on and protruding from an end of the cover panel 20B and mounted slidably over the rail rib 162B. Each cover panel 20B has a recess 22B defined in a top surface of the cover panel 20B and having a flat bottom surface. The guiding segment 24B of each cover panel 20B comprises two triangular inclined abutting ribs, and each triangular inclined abutting rib has an inclined guiding edge 242B.

Figure 10:
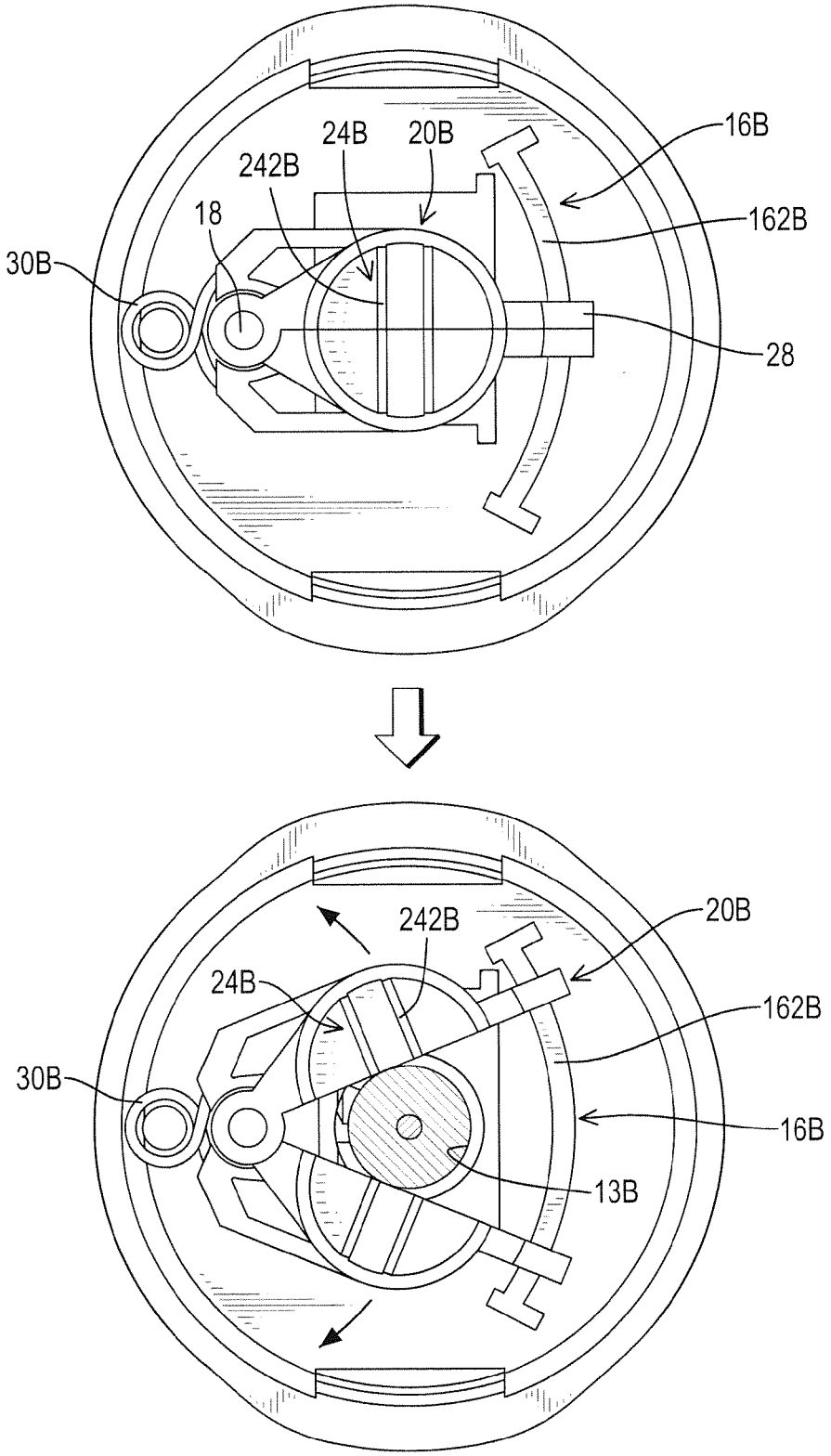
FIG. 10 shows operational top views in partial section of the automatic cover-opening device in FIG. 8 when an object is inserted.

With reference to FIG. 10, when a pencil is inserted into the device, the axial force of the pencil is exerted on the inclined guiding edges 242B of the guiding segments 24B, the lateral component force is generated due to an incline of the guiding edges 242B for opening the cover panels 20B. The cover panels 20B are pivoted relative to the pivotal axle 18 and slide relative to the rail 16B. Consequently, the insertion hole 13B is open. After the pencil is sharpened and drawn out from the device, the cover panels 20B will pivot to the closed position for closing the insertion hole 13B by the force provided by the recoil mechanism.

Figure 11:
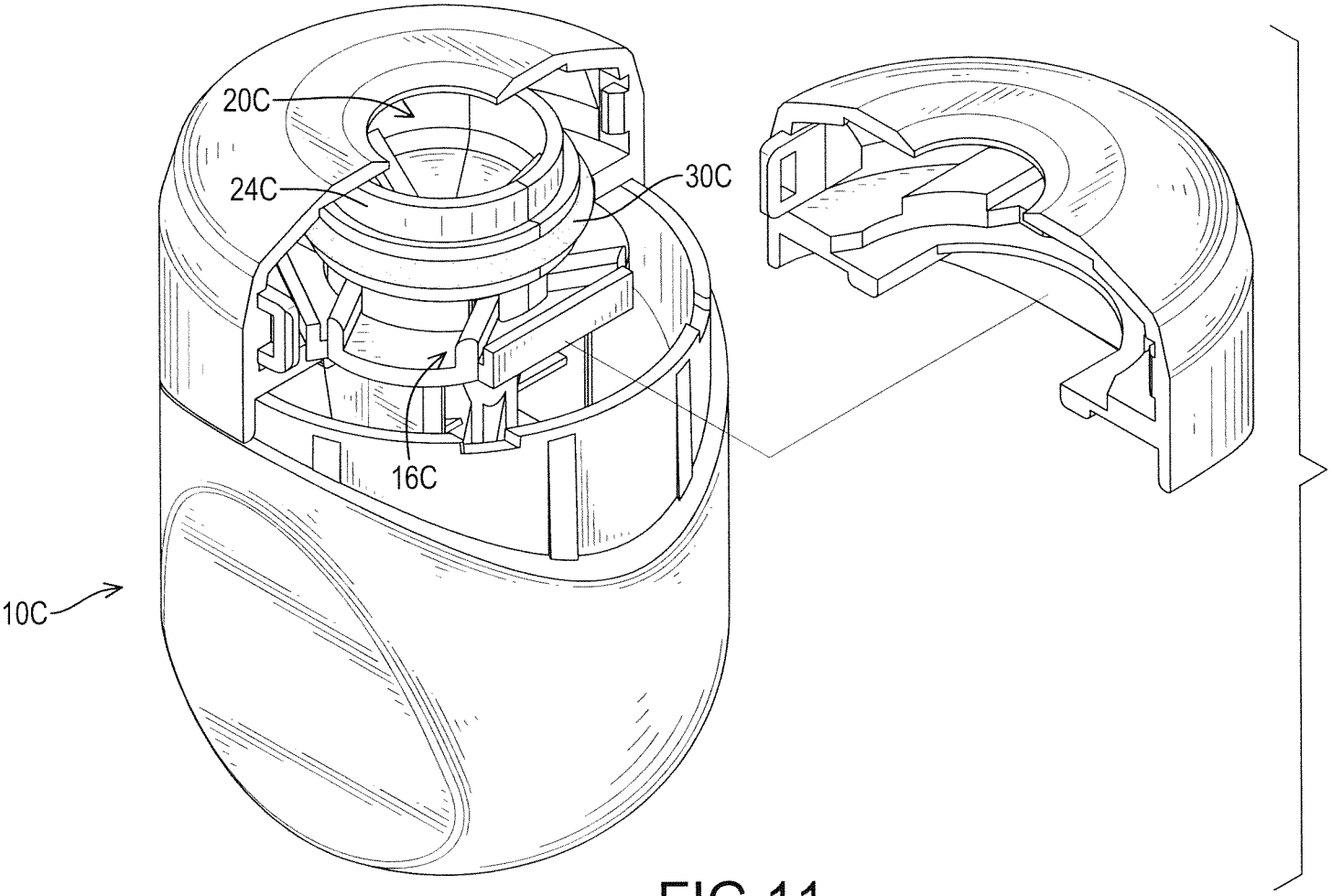
FIG. 11 is a partially exploded perspective view of a fourth embodiment of an automatic cover-opening device in accordance with the present invention.
Figure 12:
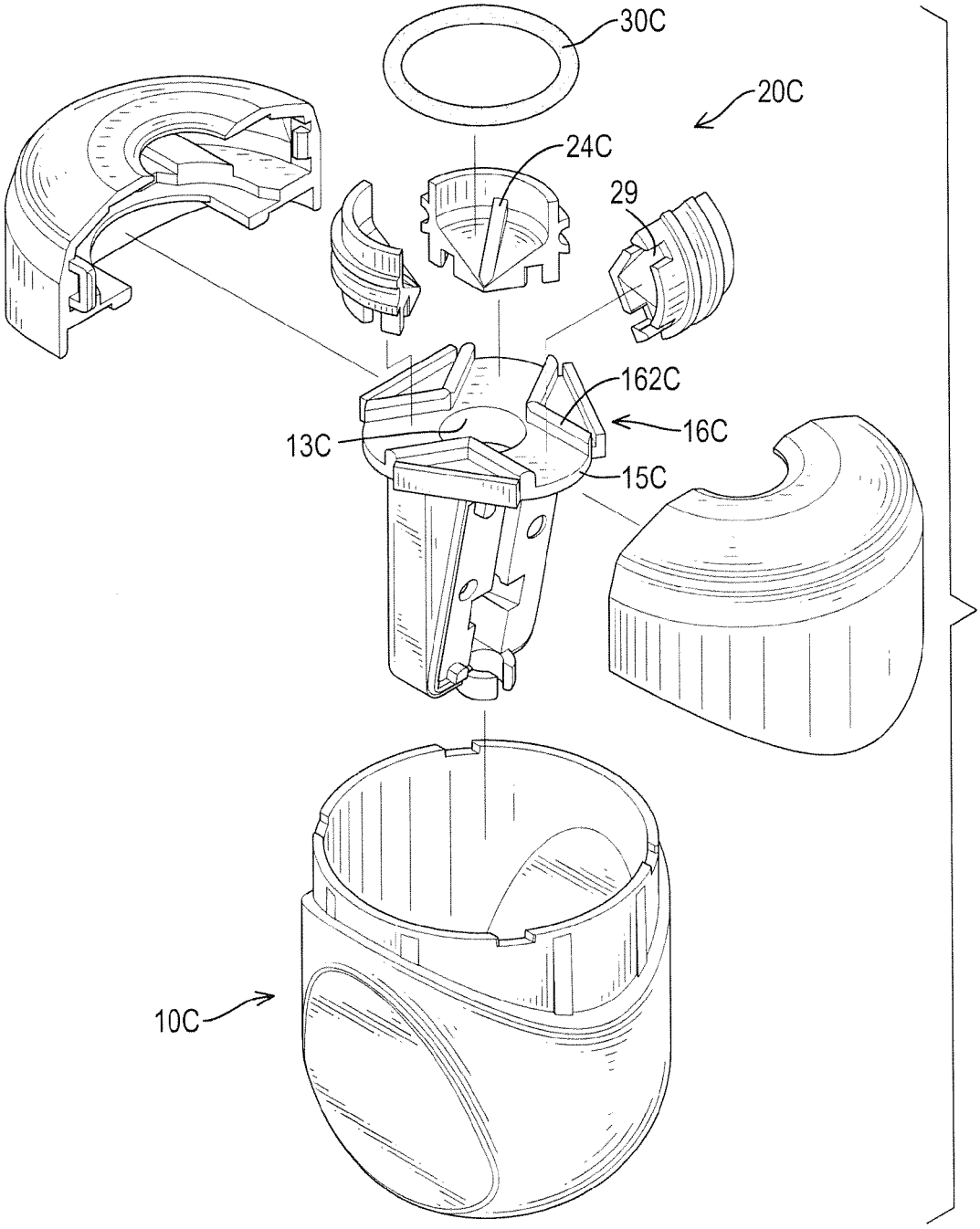
FIG. 12 is an exploded perspective view of the automatic cover-opening device in FIG. 11.
Figure 13:
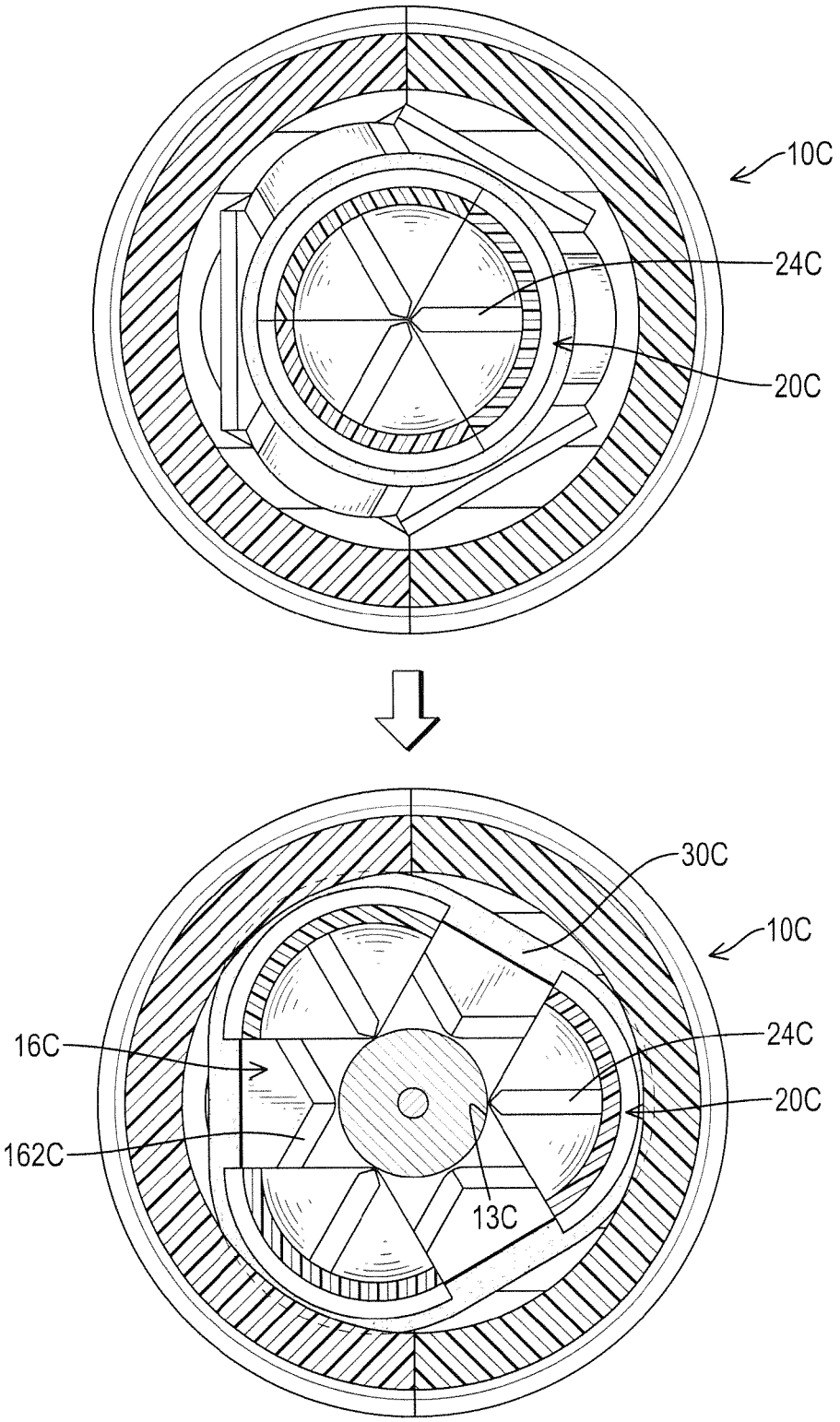
FIG. 13 shows operational top views in partial section of the automatic cover-opening device in FIG. 11 when an object is inserted.

With reference to FIGS. 11 to 13, a fourth embodiment of an automatic cover-opening device in accordance with the present invention, three moveable cover panels 20C are implemented in the body 10C to close the insertion hole 13C. The cover panels 20C are fan-shaped in cross section and are formed in combination as a complete round cover to close the insertion hole 13C. The insertion hole 13C is defined in the cutter assembly 15C. The guiding segment 24C on each cover panel 20C comprises an abutting rib with a thick top and a thin bottom. The rail 16C in the body 10C comprises three sets of rail ribs 162C radially arranged around the insertion hole 13C and is disposed on a top surface of the cutter assembly 15C. Each set of rail ribs 162C comprises two rail ribs 162C parallel with each other. Each cover panel 20C has a rail channel 29 defined in a bottom of the cover panel 20C and holds one of the sets of rail ribs 162C inside the rail channel 29. Accordingly, each cover panel 20C is moveable relative to one of the sets of rail ribs 162C. The recoil mechanism comprises a resilient ring 30C mounted around the three cover panels 20C.

With reference to FIG. 13, when a pencil is inserted into the device, an end of the pencil will abut the guiding segments 24C on the cover panels 20C. The cover panels 20C are pushed to move away from the center of the insertion hole 13C relative to the rail 16C, and the insertion hole 13C is open to enable the pencil to be inserted into the body 10C and the resilient ring 30C is expanded. After the pencil is drawn out from the device, the cover panels 20C will move toward the center of the insertion hole 13C and close the insertion hole 13C by the force provided by the resilient ring 30C. An automatic cover-closing effect is provided. With the resilient ring 30C mounted around the three cover panels 20C, a same recoil force provided by the resilient ring 30C can be evenly applied to the three cover panels 20C.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An automatic cover-opening device comprising:

a body having an insertion hole defined in the body;

at least one cover panel mounted on the body and displaceable to open and close the insertion hole, the at least one cover panel having a recess defining a bottom surface;

a guiding segment formed on said bottom surface, said guiding segment being inclined relative to an axis of the insertion hole and having at least one inclined abutting rib defining an inclined wall extending above said bottom surface, said inclined wall having an inclined guiding edge, whereby a lateral component force is generated due to the inclined guiding edge to displace said at least one cover panel when a member exerts a force on the guiding segment in a direction parallel to the axis to uncover the insertion hole to allow the member to enter the insertion hole; and a recoil mechanism disposed on the body to push the at least one cover panel to a closed position for closing the insertion hole.

2. The automatic cover-opening device as claimed in claim 1, wherein the at least one cover panel has a top, and the recess is defined in the top at a position corresponding to the insertion hole.

3. The automatic cover-opening device as claimed in claim 2, wherein the recess of the at least one cover panel has a guiding concave defined in the recess at a position adjacent to a bottom of the guiding segment.

4. The automatic cover-opening device as claimed in claim 1, wherein the at least one inclined abutting rib has a thickness gradually decreasing from a top end to a bottom end of the at least one inclined abutting rib.

5. The automatic cover-opening device as claimed in claim 2, wherein the bottom surface of the recess is tapered.

6. The automatic cover-opening device as claimed in claim 2, wherein the at least one inclined abutting rib on the at least one cover panel has a thickness gradually decreasing from a top end to a bottom end of the at least one inclined abutting rib.

7. The automatic cover-opening device as claimed in claim 2, wherein the bottom surface of the recess in the at least one cover panel is flat.

8. The automatic cover-opening device as claimed in claim 7, wherein the at least one abutting rib of the guiding segment on the at least one cover panel is implemented as two triangular inclined abutting ribs;

the at least one guiding edge of the guiding segment is implemented as four guiding edges; and each of the triangular inclined abutting ribs of the guiding segment on the at least one cover panel has respective two of the four guiding edges.

9. The automatic cover-opening device as claimed in claim 1, wherein at least one abutting rib of the guiding segment on the at least one cover panel is implemented as two triangular inclined abutting ribs;

the at least one guiding edge of the guiding segment is implemented as four guiding edges; and each of the triangular inclined abutting ribs of the guiding segment on the at least one cover panel has respective two of the four guiding edges.

10. The automatic cover-opening device as claimed in claim 1, wherein the body further comprises a rail on which the at least one cover panel is moveably mounted in a straight line;

the rail comprises two rail tabs being parallel with each other; and the at least one cover panel is mounted moveably over the rail tabs.

11. The automatic cover-opening device as claimed in claim 1, wherein the recoil mechanism comprises at least one spring abutting respectively the at least one cover panel.

12. The automatic cover-opening device as claimed in claim 1, wherein the recoil mechanism comprises a resilient ring mounted around the at least one cover panel.

13. The automatic cover-opening device as claimed in claim 1, wherein the body further comprises a rail comprising two rail tabs, each of which has a respective inclined surface on at least one side thereof; and a wing formed on and protruding from a side of the at least one cover panel and abutting respectively the two rail tabs of the rail.

14. The automatic cover-opening device as claimed in claim 1, wherein the at least one cover panel is pivotally mounted on a pivotal axle of the body.

15. The automatic cover-opening device as claimed in claim 14, wherein the body further comprises a rail comprising a curved rail rib having a center at the pivotal axle; and a rail bracket formed on and protruding from an end of the at least one cover panel and mounted slidably over the rail rib.

16. The automatic cover-opening device as claimed in claim 1, wherein the recoil mechanism comprises a torque spring.

17. The automatic cover-opening device as claimed in claim 1, wherein the body further comprises multiple rail ribs arranged around the insertion hole; and the at least one cover panel has a rail channel defined in a bottom of the at least one cover panel and holding one of the rail ribs inside the rail channel.

* * * * *